US005905342A

United States Patent [19]

Mimasu et al.

[11] Patent Number: 5,905,342

[45] Date of Patent: May 18, 1999

[54] MICROWAVE-EXCITED DISCHARGE LAMP HAVING INNER AND OUTER CASES FOR PROVIDING IMPEDANCE MATCH CONDITIONS

[75] Inventors: Mutsumi Mimasu, Hikone; Koichi Katase, Osaka, both of Japan

[73] Assignee: Matsushita Electronics Corporation, Osaka, Japan

[21] Appl. No.: 08/758,864

[22] Filed: Dec. 2, 1996

[30] Foreign Application Priority Data

Dec. 4, 1995 [JP] Japan ..... 7-315219

[51] Int. Cl.[6] ..... H01J 65/04

[52] U.S. Cl. ..... 315/39; 315/248; 313/25; 313/634

[58] Field of Search ..... 315/39, 248, 267, 315/344; 313/25, 160, 634

[56] References Cited

U.S. PATENT DOCUMENTS

| | | | |
|---|---|---|---|
| 2,188,298 | 1/1940 | Hitchcock | 313/25 X |
| 4,180,763 | 12/1979 | Anderson | 315/248 |
| 4,427,923 | 1/1984 | Proud et al. | 315/39 X |
| 5,153,482 | 10/1992 | Keijser et al. | 313/25 X |

OTHER PUBLICATIONS

D.A. MacLennan et al.; "P–73: Small Long–Lived Stable Light Source for Projection–Display Applications"; SID 93 Digest, pp. 716–719.

*Primary Examiner*—Benny T. Lee

*Attorney, Agent, or Firm*—Panitch Schwarze Jacobs & Nadel, P.C.

[57] ABSTRACT

A microwave-excited discharge lamp (2) is constructed with a double-case structure consisting of an outer case (3) disposed in a microwave electromagnetic field, and an inner case (4) disposed inside the outer case.

4 Claims, 2 Drawing Sheets

MICROWAVE-EXCITED DISCHARGE LAMP HAVING INNER AND OUTER CASES FOR PROVIDING IMPEDANCE MATCH CONDITIONS

FIELD OF THE INVENTION AND RELATED ART STATEMENT

1. Field of the Invention

The present invention relates to a microwave-excited discharge lamp which emits light by discharge under a microwave electromagnetic field.

2. Description of the Related Art Statement

In recent years, in accordance with desires to save energy etc., high intensity discharge lamps have been attracting attention. The reason is that high intensity discharge lamps can easily provide large light output compared with fluorescent lamps which give light output through phosphors. The high intensity discharge lamps are divided into two types: an electrode type discharge lamp having electrodes, such as a metal halide lamp and a mercury lamp; and an electrodeless type discharge lamp such as a microwave-excited lamp.

In the microwave-excited lamp, a predetermined microwave electromagnetic field is formed by a magnetron or a microwave generator, and plasma discharge caused by a microwave electromagnetic field is used as a light source. The microwave-excited lamp has a long life compared with the electrode type discharge lamp which are limited by deterioration of the electrodes. Furthermore, in the microwave-excited lamp, an emission spectrum of the light output does not deteriorate after long periods of service because of electrodeless configuration.

Moreover, since change of impedance between operating condition and extinguished condition is small, the microwave-excited discharge lamp provides far greater advantages than the electrode type discharge lamp with regard to characteristics of flashing operation, starting, and restarting. The microwave-excited discharge lamp also has a remarkable advantage over the electrode type discharge lamp because of environmental protection concerns. The reason is that, as has been described in the above, the microwave-excited discharge lamp has a long life, thereby components of the microwave-excited discharge lamp need not be changed for a long time. Furthermore, the microwave-excited discharge lamp gives light output having the brightness and efficacy comparable to those of the electrode type discharge lamp without use of environment-harmful mercury.

A conventional microwave-excited lighting apparatus comprises a magnetron for generating a microwave, a waveguide for transmitting the generated microwave to a cavity, the cavity connected to the waveguide, and a microwave-excited lamp disposed inside the cavity.

The microwave-excited lamp is formed into a bulb of substantially spherical shape or an elongated cylindrical shape by quartz glass or like material having a transparent or translucent property, and is supported by a glass supporting rod in the internal space of the cavity. A rare gas such as argon, a small amount of mercury, and metal halides such as thallium iodide are sealed inside the microwave-excited lamp as luminescent material. The internal pressure of the microwave-excited lamp in the extinguished condition is adjusted to a range between about 13 kPa and 27 kPa in order to easily perform a starting operation, namely, the beginning of the below-mentioned plasma discharge of the rare gas.

In the conventional microwave-excited lighting apparatus, when a high voltage is supplied to the magnetron from a high voltage power supply, for example, a microwave of 2,450 MHz is radiated into the internal space of the waveguide from an antenna of the magnetron. The microwave is propagated through the waveguide, and is radiated into the cavity through an aperture opened in the waveguide. Thereby, the predetermined microwave electromagnetic field is formed in the internal space of the cavity. When the microwave electromagnetic field is applied, dielectric breakdown of the rare gas occurs, and thereby, the plasma discharge of the rare gas is started. According to this plasma discharge, the temperature on the inside walls of the microwave-excited lamp rises, as a result of which the mercury and the metal halides are vaporized, thereby the internal pressure of the microwave-excited lamp increases. In a steady state operating condition in which the internal pressure and the temperature at the coldest point on the inside walls are stabilized at respective predetermined values (for example, at 101.3 kPa to 202.6 kPa and at 500 to 600° C., respectively), light having a predetermined emission spectrum is generated in the microwave-excited lamp by the plasma discharge of metal vapor. Thereby, the light is radiated outside as light output from the cavity through a metal mesh plate. In the above-mentioned steady state operating condition, pressure caused by the metal vapor occupies a larger volume than pressure caused by the rare gas in the internal pressure of the microwave-excited lamp.

Furthermore, in the steady state operating condition, the impedance matching condition between the waveguide and a resonator consisting of the cavity and the microwave-excited lamp is satisfied. In other words, a value of load of the resonator (hereafter referred to as an "input impedance of the resonator") becomes larger than a value of input impedance of the resonator in the extinguished condition, and reaches a value substantially equal to an inherent impedance of the waveguide (hereafter referred to as an "impedance on the power supply side"). The input impedance of the resonator is dependent on the following types of power loss, (1) and (2).

(1) Power loss due to the plasma discharge in the microwave-excited lamp.

(2) Power loss due to eddy currents generated on an inside wall of the cavity.

In the steady state operating condition, therefore, the microwave is radiated toward the cavity with hardly any reflections at the aperture of the waveguide, and thereby, the plasma discharge is produced efficiently in the microwave-excited lamp.

The conventional microwave-excited lamp takes several seconds until it reaches the steady state operating condition from start of lighting operation. However, as disclosed in unexamined and published Japanese patent application TOKKAI (SHO) No. 57-63768, for example, there is a type of microwave-excited lamp wherein an necessary time from the start of the lighting operation until reaching the steady state operating condition is reduced to about 1 second by sealing two or more kinds of halogens in the microwave-excited lamp.

In the above-mentioned conventional microwave-excited lamp, the plasma discharge occurring inside the microwave-excited lamp changes due to changes in environmental conditions such as an ambient temperature. Thereby, there is a problem that the power loss due to the plasma discharge also change. As a result, the input impedance of the resonator is not equal to the impedance on the power supply side by influence of the change of environmental conditions.

There is a problem that the impedance matching condition between the resonator and the waveguide cannot be satisfied. This has also lead to further problems that the microwave is reflected at the aperture of the waveguide toward the magnetron, and that the microwave leaks outside from the mesh plate. As a result, it is impossible to form a predetermined microwave electromagnetic field in the internal space of the cavity. There occurs a problem that the light output cannot be radiated efficiently. In the case that the microwave is reflected back toward the magnetron, the reflected microwave is superimposed on the microwave radiated from the antenna, so that the microwave is distorted. As a result, the predetermined microwave electromagnetic field cannot be formed in the internal space of the cavity. Furthermore, there is a liability that the reflected microwave incident on the antenna damages the magnetron, and shortens the life of the microwave-excited lighting apparatus.

On the other hand, in the case that the microwave leaks outside from the mesh plate, the predetermined microwave electromagnetic field cannot be formed in the internal space of the cavity. This has also led to a problem in which the microwave induces high-frequency noise, so that the high-frequency noise adversely affects electronic apparatus in the vicinity of the microwave-excited lighting apparatus.

In the conventional microwave-excited discharge lamp, when the microwave-excited discharge lamp attains to a small size in order to reduce size of the light source, the aforementioned problem about the impedance matching condition is improved. By miniaturization of the microwave-excited discharge lamp, the power loss due to the plasma discharge decreases, and the input impedance of the resonator also decreases.

On the other hand, the impedance on the power supply side can be reduced, for example, by reducing the internal volume of the waveguide. However, the waveguide has a high-pass filtering characteristic, and its cutoff frequency is dependent on the shape of the waveguiding channel inside the waveguide. Hence, another problem arises that microwaves cannot be propagated through the waveguiding channel if the waveguiding channel is made too small. Therefore, it is practically impossible to reduce the impedance on the power supply side in corresponding relationship to the input impedance of the resonator. As has been explained in the above, when the conventional microwave-excited discharge lamp attains to the small size, the impedance matching condition between the resonator and the waveguide can not be satisfied.

Furthermore, in the case that the light output from the light source is used by means of converging the light through a lens or a reflecting mirror, reducing the size of the light source is highly recommended in order to efficiently extract the light output. As described in "Small Long-Lived Stable Light Source for Projection- Display Applications," International Symposium Digest, Technical Report, Vol. 24, pp. 716–719, for example, when a microwave-excited discharge lamp is used as a backlight source for a projection display, it is highly recommended that the microwave-excited discharge lamp be small in size in order to efficiently extract the light output from the backlight source.

However, in the conventional microwave-excited discharge lamp, when the conventional microwave-excited discharge lamp attains to the small size, there is the problem that the impedance matching condition between the resonator and the waveguide can not be satisfied. Thereby, it is difficult to use the conventional microwave-excited discharge lamp for the backlight source of the projection display.

OBJECTS AND SUMMARY OF THE INVENTION

The object of the present invention is to provide a microwave-excited discharge lamp that can solve the aforementioned problems.

In order to achieve the above-mentioned object, a microwave-excited discharge lamp in accordance with the present invention comprises:

an outer case disposed in a microwave electromagnetic field, and the outer case sealing at least a discharge gas, and an inner case disposed inside the outer case, and the inner case sealing at least a discharge gas.

According to the present invention, the microwave-excited discharge lamp is constituted with a double-case construction consisting of the outer case disposed in the microwave electromagnetic field and the inner case disposed inside the outer case. Thereby, a plasma discharge as prescribed in the design can be produced within the inner case without being affected by the environmental conditions such as temperature, wind, humidity, etc., to which the microwave-excited discharge lamp is subjected. In this way, the effects of the environmental conditions on the microwave-excited discharge lamp can be reduced.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

Hereafter, a preferred embodiment of the present invention is described with reference to the accompanying drawing.

Figure 1:
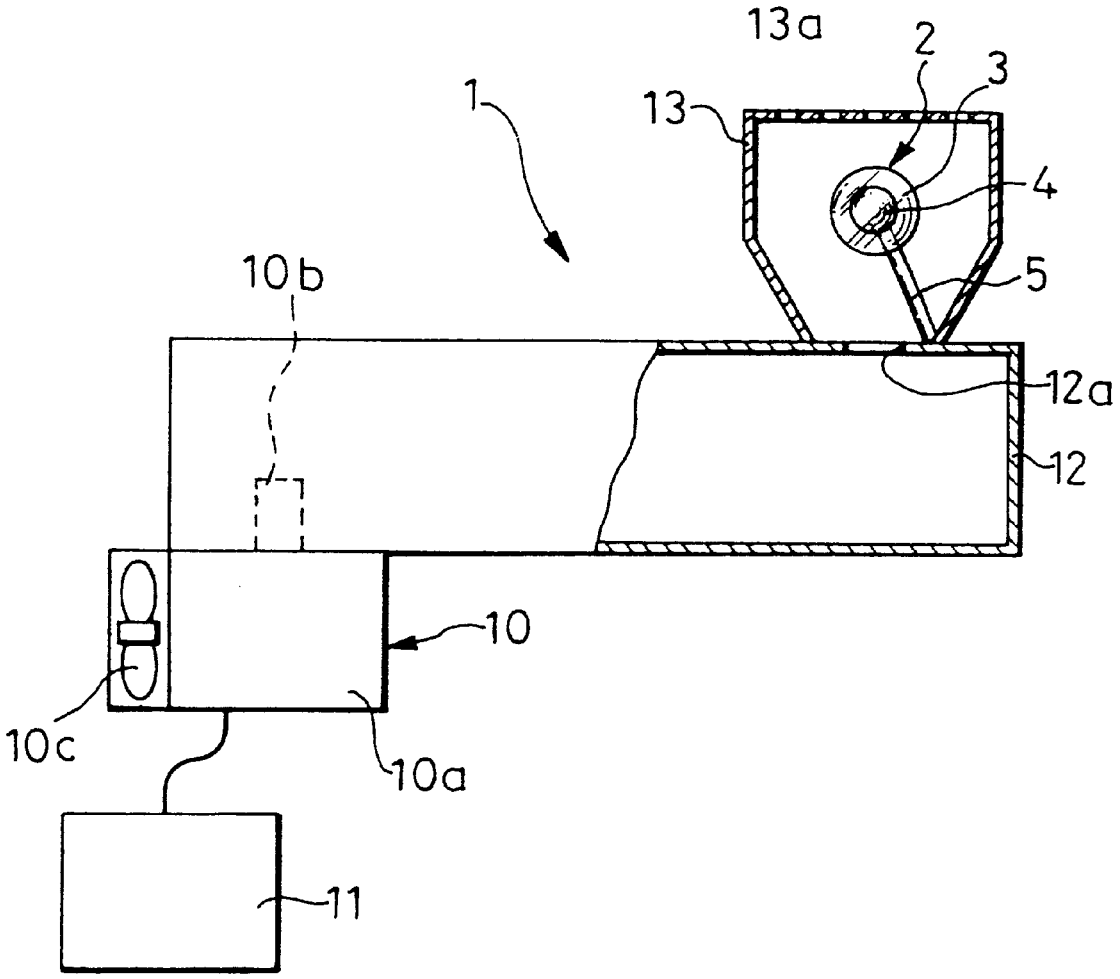
FIG. 1 is a schematic plan view showing a basic construction of a microwave-excited lighting apparatus equipped with a microwave-excited discharge lamp in a first embodiment of the present invention.

FIG. 1 is a schematic plan view showing a basic construction of a microwave-excited lighting apparatus equipped with a microwave-excited discharge lamp in a first embodiment of the present invention.

In FIG. 1, a microwave-excited lighting apparatus 1 comprises a magnetron unit 10 for generating a microwave, a waveguide 12 for transmitting the microwave to a cavity 13, and a microwave-excited discharge lamp 2 disposed inside the cavity 13.

The magnetron unit 10 comprises a magnetron 10*a* for generating a microwave, for example, at a frequency of 2,450 MHz and with an output power of 250 to 400 W, an antenna 10*b* for radiating a generated microwave, and a fan 10*c* for cooling the magnetron 10*a*. The magnetron 10*a* is connected to a high voltage power supply 11 which drives the magnetron 10*a*.

The waveguide 12 is a metal box having, for example, a rectangular cross section. The antenna 10*b* is contained in one end part of the waveguide 12, and an aperture 12*a* is opened in the other end part of the waveguide 12. The waveguide 12 is constructed in accordance with, for example, the EIA (Electronic Industries Association) standards. In order to propagate the microwave in the range of 2,170 MHz to 3,300 MHz efficiently, for example, length of the waveguide 12 is 100 cm, and rectangular cross-sectional dimensions of the waveguide 12 are 86.36 mm×43.18 mm.

The cavity 13 is constructed with a metal enclosure substantially cylindrical in shape, and mounted at one open end thereof on a surface of the waveguide 12 so as to encircle the aperture 12*a* opened in the waveguide 12. The other open end is a light output extraction port on which a metal mesh plate 13*a* is mounted. Microwave energy is stored in the internal space of the cavity 13. When a microwave is radiated through the aperture 12*a*, a predetermined microwave electromagnetic field is formed in the internal space of the cavity 13. When the impedance matching condition described later is satisfied, the cavity 13 does not allow the microwave to leak outside through the mesh plate 13*a*, so that a plasma discharge can be produced efficiently in the microwave-excited discharge lamp 2. Thereby, the light output can be radiated outside through the mesh plate 13*a* without wastage. Furthermore, a visible light reflecting mirror (not shown) is provided on the inside walls of the cavity 13 in order to direct the light output efficiently.

Figure 2:
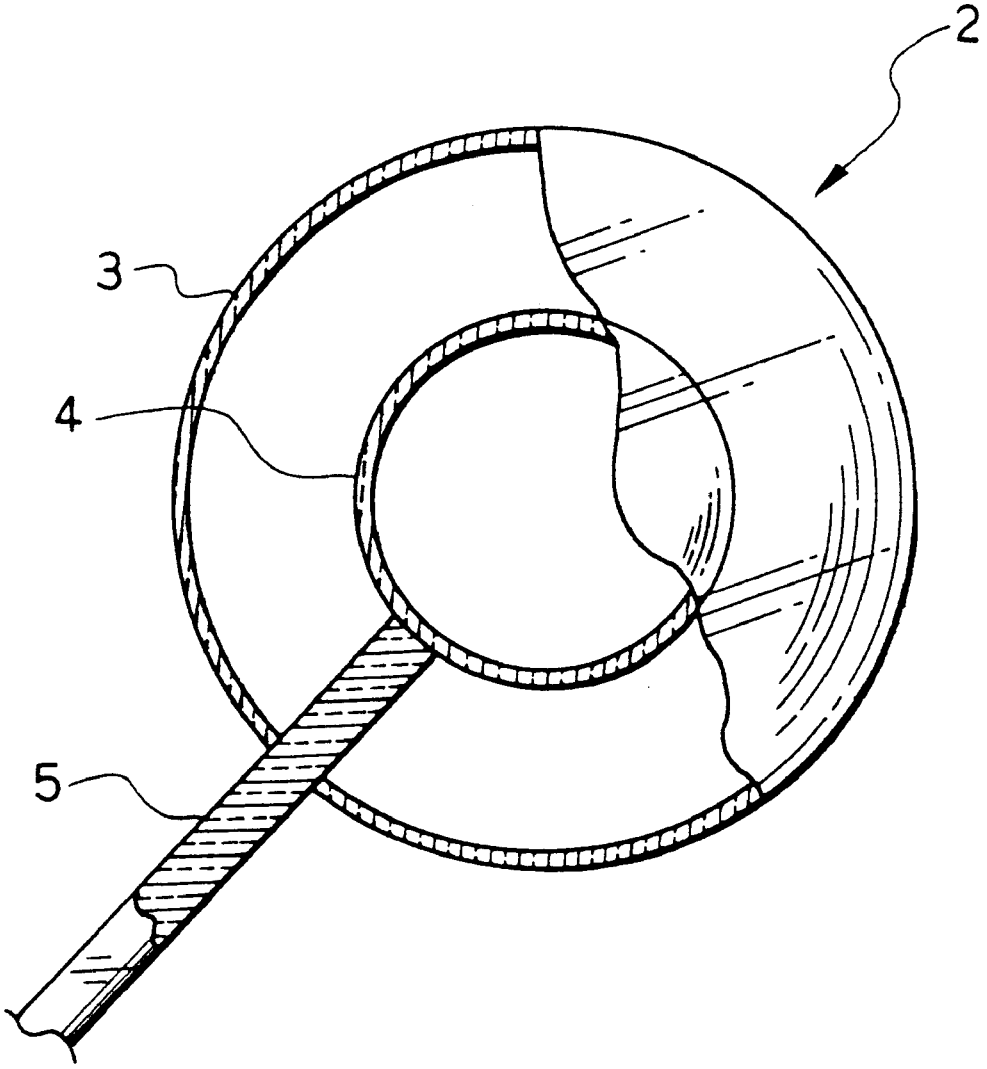
FIG. 2 is an enlarged perspective view showing the microwave-excited discharge lamp in the first embodiment of the present invention.

The microwave-excited discharge lamp 2 of the present invention will be elucidated with reference to FIG. 2. FIG. 2 is an enlarged perspective view showing the microwave-excited discharge lamp in the first embodiment of the present invention.

As shown in FIG. 2, the microwave-excited discharge lamp 2 comprises an airtight outer case 3 shaped in a bulb form and disposed in the predetermined microwave electromagnetic field, and an airtight inner case 4 shaped in a bulb form and enclosed inside the outer case 3 in concentric relationship therewith. The outer case 3 and the inner case 4 are both supported on a supporting rod 5, made of quartz glass or the like, inside the internal space of the cavity 13 as shown in FIG. 1. The supporting rod 5 supports the outer case 3 and the inner case 4 so that the supporting rod 5 does not affect the airtightness of the outer case 3. The outer case 3 and the inner case 4 are each made of a material having a transparent or translucent property such as quartz glass or alumina. The diameter of the outer case 3 is, for example, 30 mm (approximately the same as a conventional single-bulb lamp designed to similar standards). The diameter of the inner case 4 is 1 mm to 10 mm, about 1/30 to 1/3 the diameter of the conventional single-bulb lamp. The outer case 3 is filled with a rare gas such as argon, along with a material, such as mercury, that does not contribute to the emission of light but emits light in the invisible region of the spectrum when a plasma discharge is produced. The inner case 4 is filled with a rare gas such as argon, along with a material, such as metal halides, that contributes to the emission of light and emits light in the visible region of the spectrum when a plasma discharge is produced. Specific examples of the material contributing to the emission of light include sodium iodide that by itself emits light over the entire visible region of the spectrum, and a compound of a plurality of metal halides such as gadolinium iodide, lutetium iodide, and thallium iodide. Instead of the metal halides, sulphur that has an emission spectrum close to that of sunlight may be used as the material that contributes to the emission of light. The internal pressures of the outer case 3 and the inner case 4 in an extinguished condition are adjusted at a few kPa to a few dozen kPa in order to easily perform a starting operation, namely, the beginning of the below-mentioned plasma discharge of the rare gas.

It will be recognized, however, that the shape of the outer case 3 and inner case 4 is not limited to the bulb form. Furthermore, the outer case 3 and inner case 4 need not be formed in geometrically similar shapes as long as the inner case 4 is enclosed inside the outer case 3 with an appropriate spacing provided therebetween.

In the as shown in FIG. 1, microwave-excited lighting apparatus 1, the microwave-excited discharge lamp 2 is constructed with a double-case structure consisting of the outer case 3 and the inner case 4. Thereby, when the plasma discharge occurs under the microwave electromagnetic field, the plasma discharge can be produced inside the inner case 4 without being affected by environmental conditions such as the ambient temperature of the microwave-excited discharge lamp 2. As a result, it is possible to reduce effects of the environmental conditions on the microwave-excited discharge lamp. Furthermore, if any of the above-mentioned materials contributing to the emission are sealed in the outer case 3, this will not cause any problems that will adversely affect the operation and the life of the microwave-excited discharge lamp 2.

In this way, in the microwave-excited discharge lamp 2 of the present invention, optimum kinds of the materials can be selected for the outer case 3 and the inner case 4 in order to satisfy the performance required as a light source.

Operation of the microwave-excited lighting apparatus 1 will be explained with reference to FIG. 1.

When a high voltage is supplied to the magnetron 10*a* from the high-voltage power supply 11, the magnetron unit 10 is activated, so that a microwave of 2,450 MHz is radiated from the antenna 10*b* into the interior of the waveguide 12. The microwave propagates through the waveguide 12, and is fed into the cavity 13 through the aperture 12*a*, thereby, the predetermined microwave electromagnetic field is formed in the internal space of the cavity 13. The microwave electromagnetic field firstly causes dielectric breakdown of the rare gas in the inner case 4, so that the plasma discharge of the rare gas is generated in the inner case 4. Consequently, the microwave electromagnetic field causes dielectric breakdown of the rare gas in the outer case 3, so that the plasma discharge of the rare gas is generated in the outer case 3. According to the plasma discharge, temperatures on the respective inside walls of the outer case 3 and the inner case 4 rise, as a result of which the mercury and the metal halides are vaporized, thereby the respective internal pressures of the outer case 3 and the inner case 4 increase. In a steady state operating condition in which the internal pressure and the temperature at the coldest point on the inside wall of the inner case 4 are stabilized at respectively predetermined values (for example, at 101.3 kPa to 202.6 kPa and at 500 to 600° C.), light having an emission spectrum defined by the sealed metal halides is produced in the inner case 4 by the plasma discharge of the metal vapor. Thereby, the light is radiated outside as light output through the mesh plate 13*a* of the cavity 13. In this steady state operating condition, pressure caused by the metal vapor occupies a larger volume than pressure caused by the rare gas in the respective internal pressures of the outer case 3 and the inner case 4.

Furthermore, in the steady state operating condition, the impedance matching condition between the waveguide 12 and the resonator consisting of the cavity 13 and the microwave-excited lamp 2 is satisfied. In other words, a value of load of the resonator, which is dependent on the power losses due to the plasma discharges within the outer case 3 and the inner case 4 and on the moderate power losses due to eddy currents generated on an inside wall of the cavity 13, becomes larger than a value of the load of the resonator in the extinguished condition. Furthermore, in the steady state operating condition, the value of load of the resonator reaches a value substantially equal to an inherent impedance of the waveguide 12.

In the steady state operating condition, therefore, the microwave is radiated toward the cavity 13 with hardly any reflections at the aperture 12*a* of the waveguide 12, and thereby, the plasma discharge is produced efficiently inside the microwave-excited discharge lamp 2. As a result, the microwave-excited discharge lamp 2 of the present invention can radiate its light output with high efficiency toward the outside through the mesh plate 13*a*.

Apart from the aforementioned explanation, wherein the magnetron unit 10 generates the microwave electromagnetic field, an alternative construction may be such that a high-frequency current may be fed through a coil to form a microwave electromagnetic field. Thereby, the microwave-excited discharge lamp 2 of the present invention may be constructed to produce light through the discharge by the microwave electromagnetic field.

Furthermore, as has been explained above, the microwave-excited discharge lamp 2 of the present invention comprises the same material in outer case 3 that does not contribute to the emission of the light while the material that contributes to the emission of light from the inner case 4. Thereby, it is possible that size of the light source is reduced. As a result, the impedance matching condition between the waveguide 12 and the resonator can be easily satisfied even when the microwave-excited discharge lamp 2 be small in size. More specifically, in the microwave-excited discharge lamp 2 of the present invention, the power loss due to the plasma discharge formed in the outer case 3 and not contributing to the emission of the light is added to the power losses due to the plasma discharge formed in the inner case 4 and the eddy currents generated on the inside wall of the cavity 13. Thereby, it is possible that the load of the resonator is made substantially equal to the intrinsic impedance of the waveguide 12. In this way, the impedance matching condition between the waveguide 12 and the resonator can be easily satisfied.

Thus, the microwave-excited discharge lamp 2 of the present invention is formed by the double-case construction consisting of the outer case 3 and the inner case 4. Thereby, the microwave-excited discharge lamp 2 enables a predetermined plasma discharge to be formed inside the inner case 4 without being affected by environmental conditions such as the ambient temperature of the microwave-excited discharge lamp 2. Furthermore, in the microwave-excited discharge lamp 2, it is possible to reduce the effects of the environmental conditions on the microwave-excited lamp 2. Moreover, since the material that does not contribute to the emission of the light is sealed into the outer case 3, the size of the light source can be reduced while satisfying the impedance matching condition between the waveguide 12 and the resonator.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A microwave-excited discharge lamp comprising:

an outer case disposed in a microwave electromagnetic field located in a resonator by a microwave radiated into the resonator by a waveguide coupled thereto, said outer case sealing a rare gas and a material for emitting non-visible light, said outer case satisfying an impedance matching condition between said waveguide and said resonator, and an inner case disposed inside said outer case, said inner case sealing a material different from said material sealed in said outer case and for emitting light when plasma discharge occurs therein.

2. A microwave-excited discharge lamp in accordance with claim 1, wherein said material sealed in said inner case emitting light in a visible region when said plasma discharge occurs.

3. A microwave-excited discharge lamp in accordance with claim 1, wherein pressure cause by a vapor of said material in said outer case occupies a larger volume then pressure caused by said rare gas in said internal pressure of said outer case in a steady state operating condition.

4. A microwave-excited discharge lamp in accordance with claim 1, wherein said microwave electromagnetic field is located inside a cavity of said resonator, and said lamp is disposed inside said cavity.

* * * * *